US012636565B1

(12) United States Patent
Mason et al.

(10) Patent No.: US 12,636,565 B1
(45) Date of Patent: May 26, 2026

(54) APPARATUS FOR PROVIDING WRIST ANGLE FEEDBACK

(71) Applicant: WhyGolf LLC, Escondido, CA (US)

(72) Inventors: Bradley R. Mason, Escondido, CA (US); Jeffrey T. Mason, Escondido, CA (US)

(73) Assignee: WhyGolf LLC, Escondido, CA (US)

( * ) Notice: Subject to any disclaimer, the term of this patent is extended or adjusted under 35 U.S.C. 154(b) by 0 days.

(21) Appl. No.: 19/284,675

(22) Filed: Jul. 30, 2025

(51) Int. Cl.
*A63B 69/36* (2006.01)
*A63B 71/06* (2006.01)

(52) U.S. Cl.
CPC ..... *A63B 69/3608* (2013.01); *A63B 71/06* (2013.01); *A63B 71/0622* (2013.01); *A63B 2071/0633* (2013.01); *A63B 2071/0655* (2013.01); *A63B 2071/0663* (2013.01); *A63B 2220/16* (2013.01); *A63B 2220/836* (2013.01)

(58) Field of Classification Search
CPC ..... A63B 69/3608; A63B 69/36; A63B 71/06; A63B 71/0622; A63B 2071/0625; A63B 2071/0633; A63B 2071/0655; A63B 2071/0602; A63B 2220/836; A63B 2220/16
See application file for complete search history.

(56) References Cited

U.S. PATENT DOCUMENTS 3,400,934 A * 9/1968 Muehl ..... A63B 71/146 473/213
3,970,305 A * 7/1976 Hawkins ..... A63B 71/14 473/62
4,017,086 A * 4/1977 Washburn ..... A63B 69/0059 473/212
5,324,038 A * 6/1994 Sasser ..... A63B 69/3608 473/212
5,823,886 A * 10/1998 Murray ..... A63B 69/3608 473/213
5,876,292 A * 3/1999 Hamilton ..... A63B 69/3608 273/DIG. 30
7,699,714 B1 * 4/2010 Reynolds ..... A63B 69/3608 473/409
8,512,161 B2 * 8/2013 Dalbke ..... A63B 71/146 473/213
11,826,626 B1 * 11/2023 Gankas ..... A63B 69/3608
2011/0224009 A1 * 9/2011 Shan ..... A63B 71/0622 473/213
2013/0184092 A1 * 7/2013 Dalbke ..... A63B 69/0059 473/205

(Continued)

*Primary Examiner* — Raleigh W Chiu
(74) *Attorney, Agent, or Firm* — CP LAW GROUP PC; Cy Bates

(57) ABSTRACT

An apparatus for providing wrist angle feedback to a user is disclosed, the apparatus including an arm cuff having a front end, a back end, a top face, and a bottom face shaped to engage the user's forearm, and a dorsal interface module hingedly coupled to the arm cuff so its distal end pivots relative to the front end while contacting the backside of the user's hand. A feedback element disposed within the dorsal interface module is configured to deliver feedback, such as auditory and/or haptic, whenever the dorsal interface module rotates toward the arm cuff, thereby giving the user immediate, repeatable cues at a predetermined wrist-extension threshold to help train optimal wrist angles, enhance swing mechanics, improve consistency, and reduce injury risk.

19 Claims, 16 Drawing Sheets

(56) References Cited

U.S. PATENT DOCUMENTS

| | | | | |
|---|---|---|---|---|
| 2020/0238150 | A1* | 7/2020 | Manley | A63B 23/12 |
| 2020/0384335 | A1* | 12/2020 | LaSala | G06F 1/1684 |
| 2024/0091618 | A1* | 3/2024 | Woods | A63B 69/0059 |
| 2024/0252898 | A1* | 8/2024 | Woods | A63B 69/3608 |

* cited by examiner

APPARATUS FOR PROVIDING WRIST ANGLE FEEDBACK

BACKGROUND

Field of the Invention

This invention relates to a golf apparatus; more particularly, a wrist apparatus for providing wrist angle feedback.

Description of the Related Art

Golf-swinging training aids are known that address wrist angle mechanical and electrical mechanisms. Many such training aids provide only feedback to preset angles without user-customization. More recent training aids incorporate electronic sensing technologies such as inertial-measurement units, gyroscopes, accelerometers, and wireless communication modules. These sensor-based systems stream continuous wrist-angle data to companion applications, offer graphical analytics, and may vibrate or sound alarms when user-selected limits are exceeded. While electronically enhanced devices deliver detailed metrics and customizable thresholds, they introduce higher cost, require batteries or charging, depend on wireless connectivity and external displays, and often demand calibration and software setup. The resulting complexity, expense, and potential distraction can deter golfers seeking a simple, self-contained solution for consistent wrist-angle training.

SUMMARY

An apparatus for providing wrist angle feedback to a user is disclosed, the apparatus comprising an arm cuff with a front end, a back end opposite the front end, a top face, and a bottom face configured to engage the user's forearm, and a dorsal interface module hingedly coupled to the arm cuff so that its proximal end pivots relative to the front end while contacting the backside of the user's hand. A feedback element is disposed within the dorsal interface module and is configured to deliver feedback, such auditory and/or haptic, whenever the dorsal interface module rotates toward the arm cuff, thereby giving the user immediate, repeatable cues at a predetermined wrist-extension threshold to help train optimal wrist angles, enhance swing mechanics, improve performance consistency, and reduce injury risk.

BRIEF DESCRIPTION OF THE DRAWINGS

Other features, combinations, and embodiments will be appreciated by one having the ordinary level of skill in the art of golf and accessories upon a thorough review of the following details and descriptions, particularly when reviewed in conjunction with the drawings, wherein.

DETAILED DESCRIPTION

Figure 1:
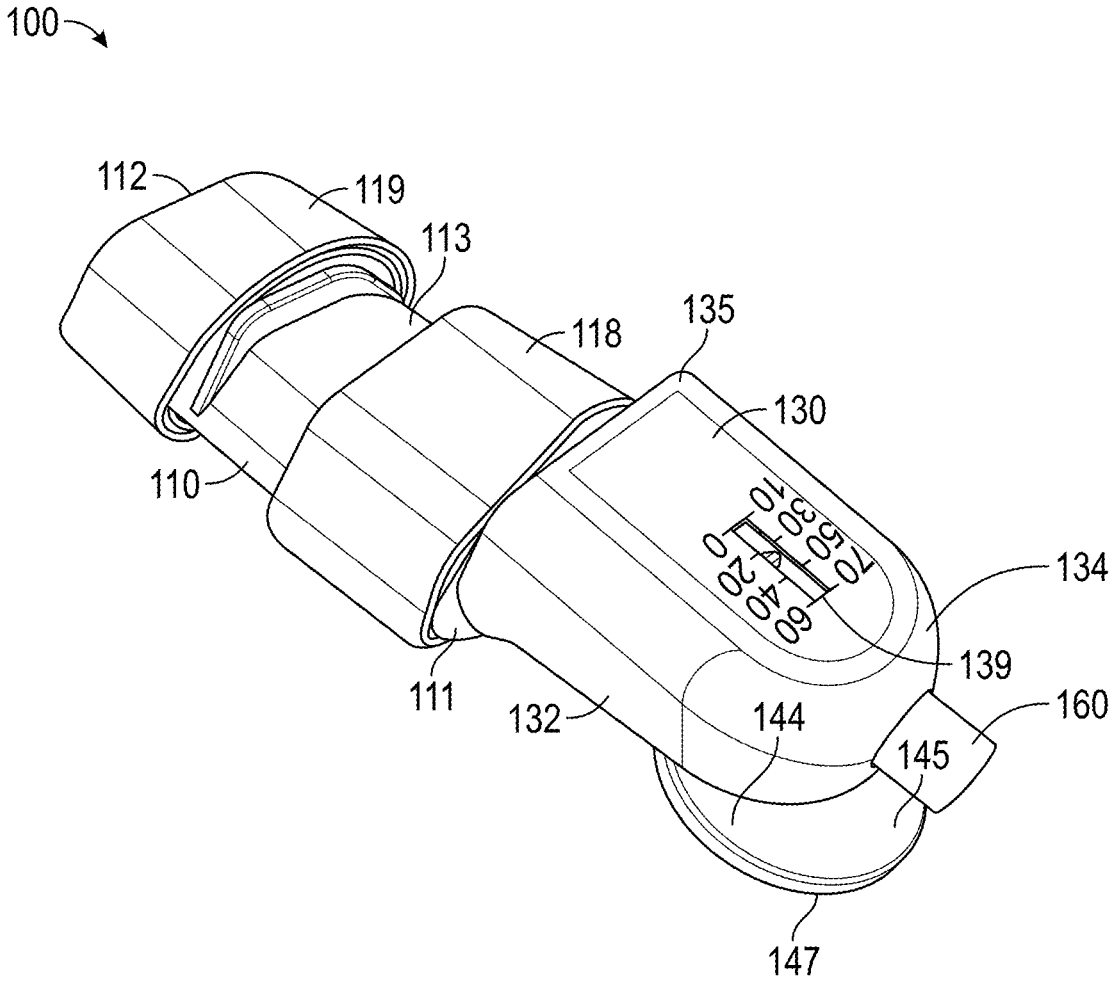
FIG. 1 shows a perspective view of an apparatus for providing wrist angle feedback in accordance with a first illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

The features, components, and configurations described in connection with the various embodiments illustrated herein may be combined, interchanged, or otherwise modified in any number of ways without departing from the scope and spirit of the invention. The embodiments are presented by way of example and not limitation, and it is intended that the invention encompasses all such combinations, permutations, and modifications as would be understood by those skilled in the art.

For purposes herein, the term "mechanical feedback" means a perceptible signal, such as auditory or haptic, generated solely through the motion, deformation, or interaction of physical mechanical components, without involvement of electrical or electronic elements.

The term "haptic feedback" means any feedback produced by an apparatus that is perceptible through the user's sense of touch and can include pressure and vibration.

The term "omnidirectionally" means the capability of an object or joint to rotate freely about multiple orthogonal axes, thereby allowing continuous rotation in every direction.

The terms "rotatably coupled" and "hingedly coupled" mean a connection in which two components are joined by a pivoting joint that permits relative rotation about at least one axis.

Unless explicitly defined herein, terms are to be construed in accordance with the plain and ordinary meaning as would be appreciated by one having skill in the art.

GENERAL DESCRIPTION OF EMBODIMENTS

In a general embodiment, an apparatus for providing wrist-angle feedback to a user is disclosed. The apparatus comprises an arm cuff that includes a front end, a back end opposite the front end, a top face, and a bottom face opposite the top face, the bottom face having a concave face configured to engage with a forearm of the user. One or more arm straps are coupled to the arm cuff A dorsal interface module is hingedly coupled to the arm cuff and is configured to contact a backside of the user's hand. The dorsal interface module has a proximal end and a distal end extending along a longitudinal axis, with the proximal end hingedly coupled to the front end of the arm cuff, and further includes a dorsal contact plate configured to rotate omnidirectionally and to engage with the backside of the user's hand. A set knob is externally accessible to adjust a set angle. A shuttle is configured to linearly reciprocate upon actuation of the set knob and to translate along the longitudinal axis. A trigger is coupled to the shuttle and hingedly coupled to the arm cuff so that, upon translation of the shuttle, the trigger is configured to rotate toward or away from the arm cuff. A feedback element is disposed within the dorsal interface module and is configured to provide mechanical feedback caused by mechanical deformation of the feedback element when the set angle between the dorsal interface module and the arm cuff is reached, the mechanical feedback including auditory feedback, haptic feedback, or both.

In some embodiments, the mechanical deformation may further comprise bending of the feedback element.

In some embodiments, the front end of the arm cuff may further comprise hinge members configured to engage with the dorsal interface module.

In some embodiments, a feedback anchor may be disposed between the hinge members, and the feedback anchor may fixedly couple the feedback element to the arm cuff.

In some embodiments, the dorsal interface module may further comprise an alignment pin extending along the longitudinal axis and a gimbal having a first rotation point and a second rotation point orthogonal to the first rotation point, the first rotation point being rotationally and translationally coupled to the alignment pin, and the dorsal contact plate may be rotationally coupled to the second rotation point.

In some embodiments, a compression spring may be disposed on the alignment pin to create a spring bias on the gimbal toward the distal end.

In some embodiments, the dorsal contact plate may include a top side and a bottom side opposite the top side, the top side may be rotationally coupled to the gimbal, and the bottom side may comprise a concave structure.

In some embodiments, the feedback element may comprise a planar body.

In some embodiments, the feedback element may further comprise a concave surface and a convex surface opposite the concave surface, the concave surface may face the distal end of the dorsal interface module, and the convex surface may face the proximal end of the dorsal interface module.

In some embodiments, a feedback retainer may be coupled to the arm cuff, and the feedback element may be configured to contact the feedback retainer upon sufficient rotation of the dorsal interface module toward the arm cuff.

In some embodiments, the shuttle may further comprise a set-angle indicator that aligns with wrist-angle markings disposed on the dorsal interface module.

In some embodiments, the trigger may further comprise a projection configured to engage with an apex of the feedback element.

In another general embodiment, an apparatus for providing wrist-angle feedback to a user is disclosed. The apparatus comprises an arm cuff having a front end, a back end opposite the front end, a top face, and a bottom face opposite the top face, the bottom face being configured to engage with a forearm of the user. A dorsal interface module is hingedly coupled to the arm cuff, is configured to contact a backside of the user's hand, and includes a distal end and a proximal end extending along a longitudinal axis, the proximal end being hingedly coupled to the front end of the arm cuff. A feedback element is disposed within the dorsal interface module and is configured to provide feedback to the user upon rotation of the dorsal interface module toward the arm cuff.

In some embodiments, the feedback may comprise auditory feedback, haptic feedback, or both.

In some embodiments, the feedback may comprise mechanical feedback.

In some embodiments, the feedback provided by the feedback element may be caused by mechanical deformation of the feedback element.

In some embodiments, the mechanical deformation may further comprise bending of the feedback element.

In some embodiments, the bottom face of the arm cuff may further comprise a concave face.

In some embodiments, an arm strap may be coupled to the arm cuff.

In some embodiments, the front end of the arm cuff may further comprise hinge members configured to engage with the dorsal interface module.

In some embodiments, a feedback anchor may be disposed between the hinge members, and the feedback anchor may fixedly couple the feedback element to the arm cuff.

In some embodiments, the dorsal interface module may further comprise a dorsal contact plate configured to rotate omnidirectionally and to engage with the backside of the user's hand.

In some embodiments, the dorsal interface module may further comprise an alignment pin extending along the longitudinal axis and a gimbal having a first rotation point and a second rotation point orthogonal to the first rotation point, the first rotation point being rotationally and translationally coupled to the alignment pin, and the dorsal contact plate may be rotationally coupled to the second rotation point.

In some embodiments, a compression spring may be disposed on the alignment pin to create a spring bias on the gimbal toward the distal end.

In some embodiments, the dorsal contact plate may include a top side and a bottom side opposite the top side, the top side may be rotationally coupled to the gimbal, and the bottom side may comprise a concave structure.

In some embodiments, the feedback element may comprise a planar body.

In some embodiments, the feedback element may further comprise a concave surface and a convex surface opposite the concave surface, the concave surface may face the distal end of the dorsal interface module, and the convex surface may face the proximal end of the dorsal interface module.

In some embodiments, a feedback retainer may be coupled to the arm cuff, and the feedback element may be configured to contact the feedback retainer upon sufficient rotation of the dorsal interface module toward the arm cuff.

In some embodiments, the feedback element may provide the feedback when a set angle is reached between the dorsal interface module and the arm cuff.

In some embodiments, the set angle may be adjustable.

In some embodiments, the set angle may be adjustable by a set knob that is externally accessible from the dorsal interface module.

In some embodiments, the dorsal interface module may further comprise a shuttle configured to linearly reciprocate upon actuation of the set knob and to translate along the longitudinal axis.

In some embodiments, the shuttle may further comprise a set-angle indicator that aligns with wrist-angle markings disposed on the dorsal interface module.

In some embodiments, the dorsal interface module may further comprise a trigger rotatably coupled to the shuttle so that, upon translation of the shuttle, the trigger may rotate toward or away from the feedback element.

In some embodiments, the trigger may be hingedly coupled to the arm cuff.

In some embodiments, the trigger may further comprise a projection configured to engage with an apex of the feedback element.

Each of the components of the apparatus described herein may be manufactured and/or assembled in accordance with the conventional knowledge and level of a person having skill in the art.

While various details, features, combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

Illustrated Embodiments

Figure 2:
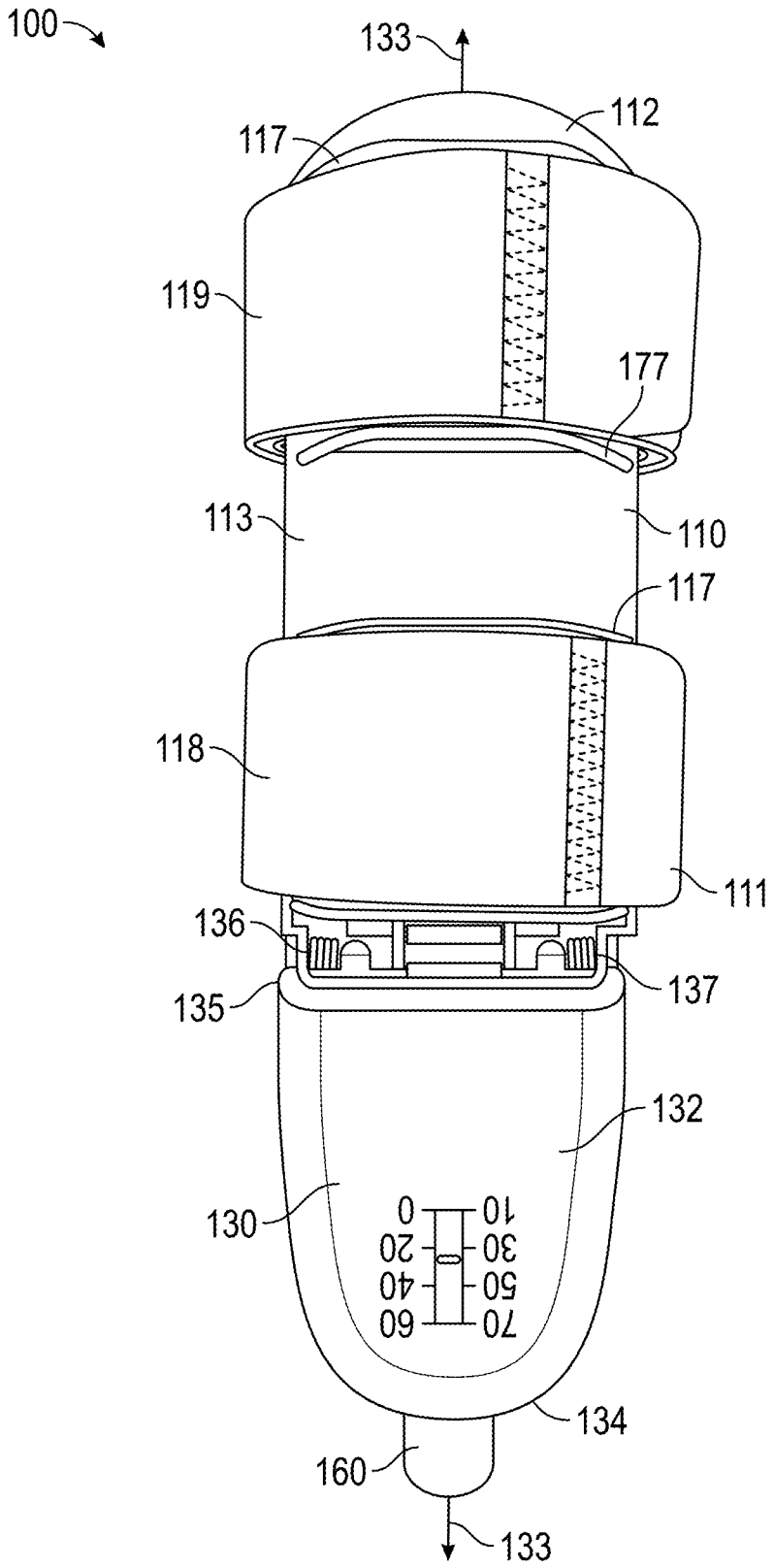
FIG. 2 shows a top view of the apparatus according to the first illustrated embodiment.
Figure 3:
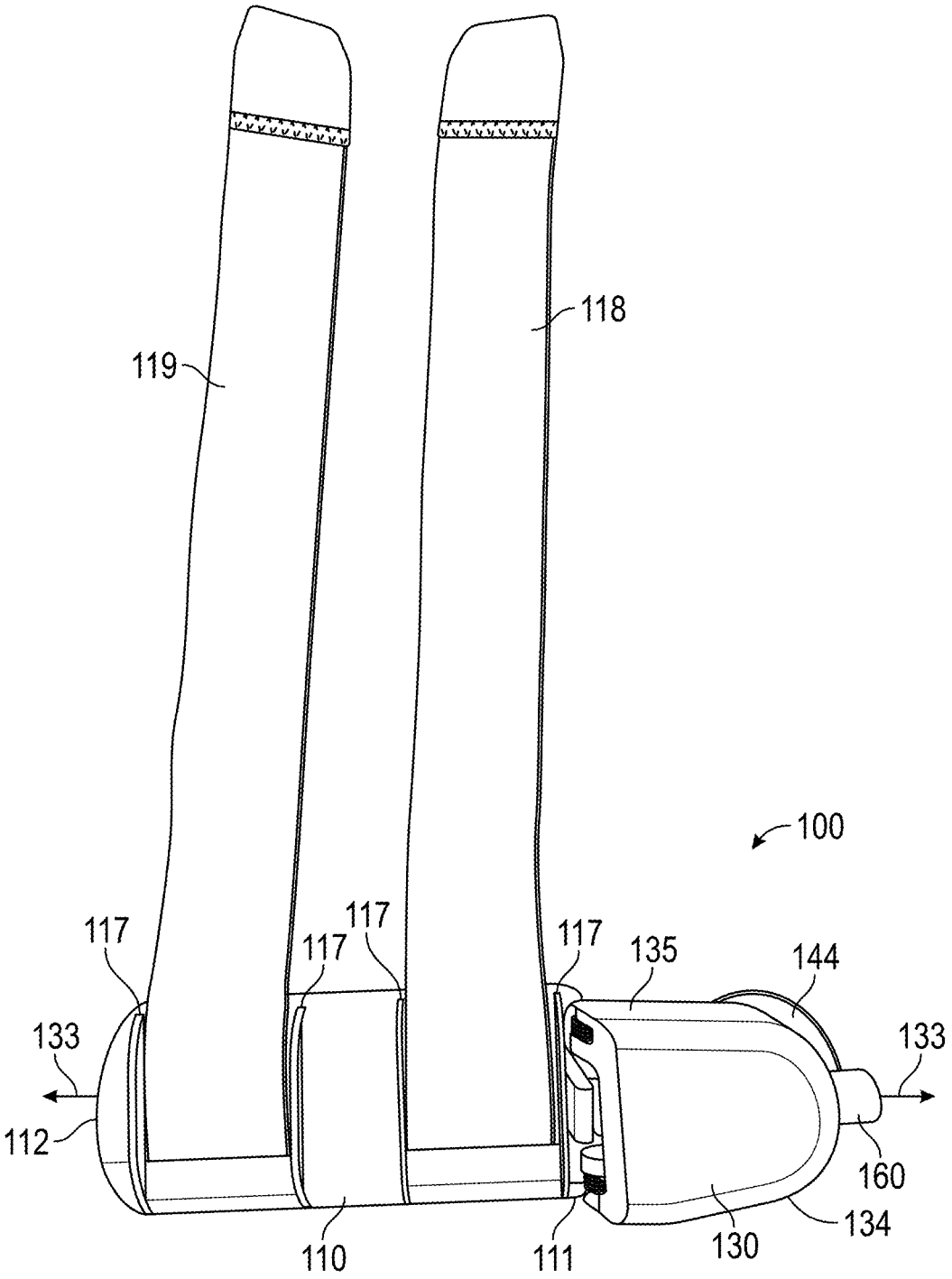
FIG. 3 shows an alternate top view of the apparatus with unraveled arm straps according to the first illustrated embodiment.
Figure 4:
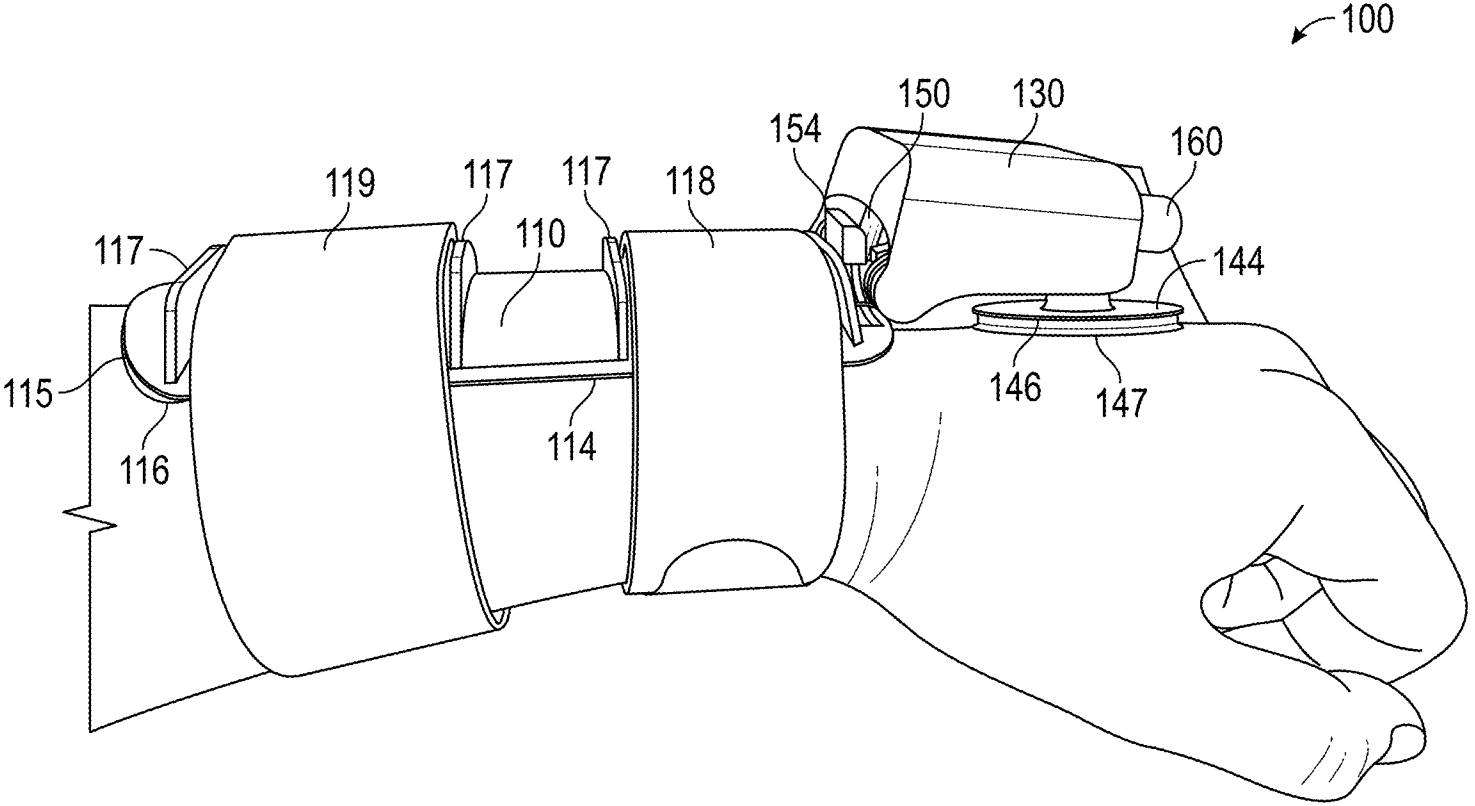
FIG. 4 shows a side view of the apparatus attached to a user in a neutral state according to the first illustrated embodiment.
Figure 5:
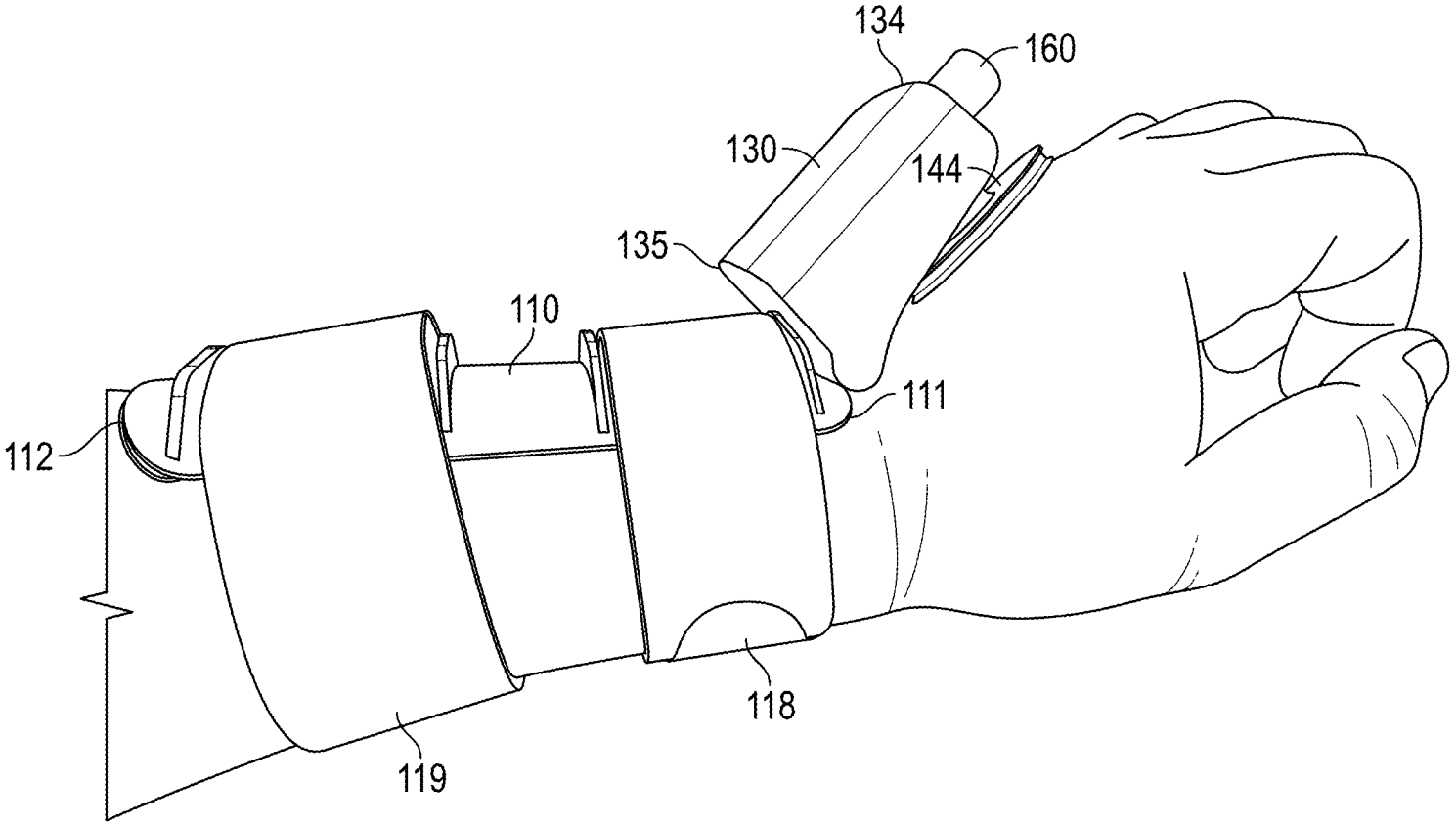
FIG. 5 shows a side view of the apparatus attached to the user in a bent state according to the first illustrated embodiment.
Figure 6:
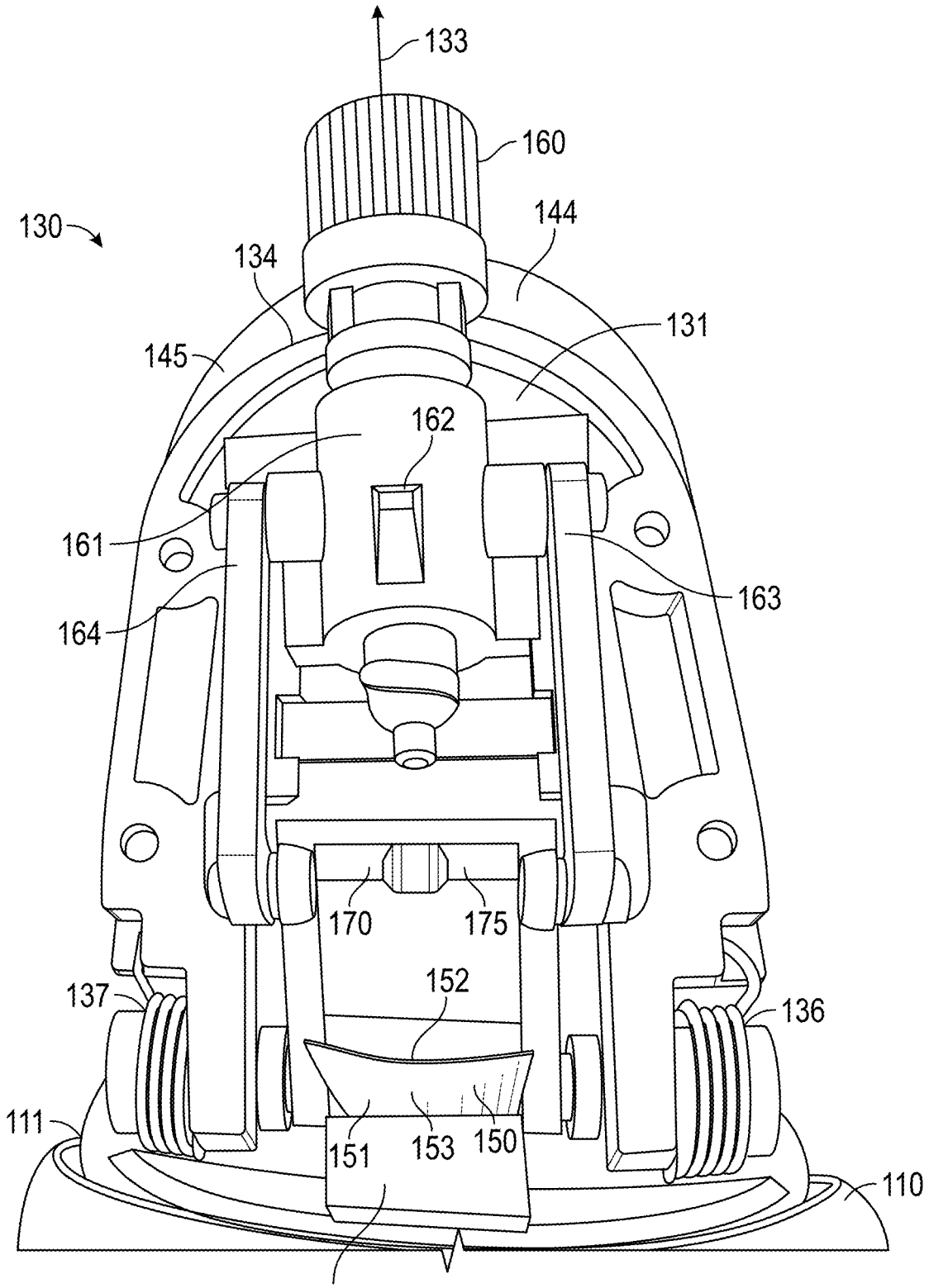
FIG. 6 shows a rear view of a dorsal interface module of the apparatus according to the first illustrated embodiment.
Figure 7:
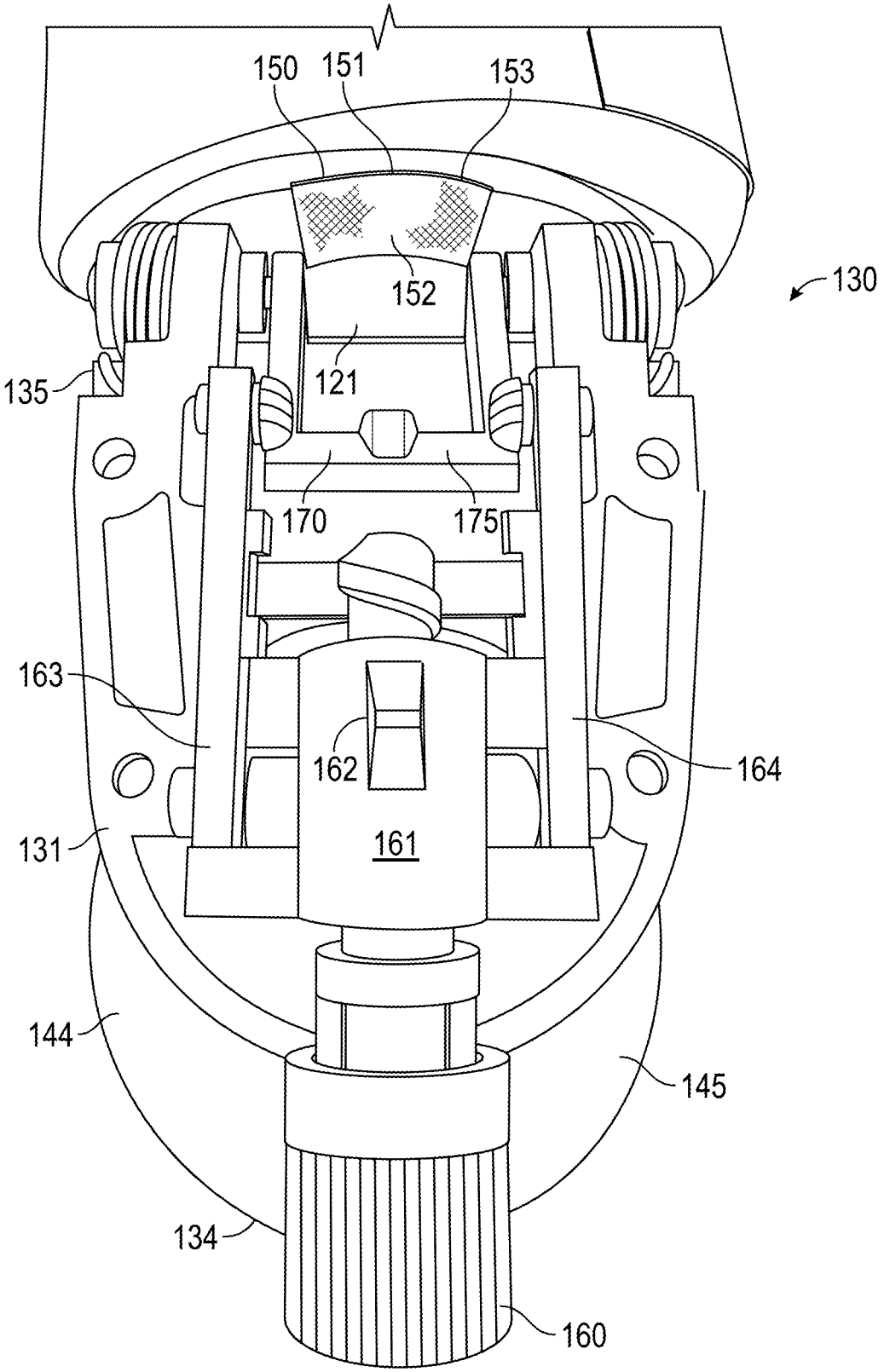
FIG. 7 shows a front view of the dorsal interface module according to the first illustrated embodiment.
Figure 8:
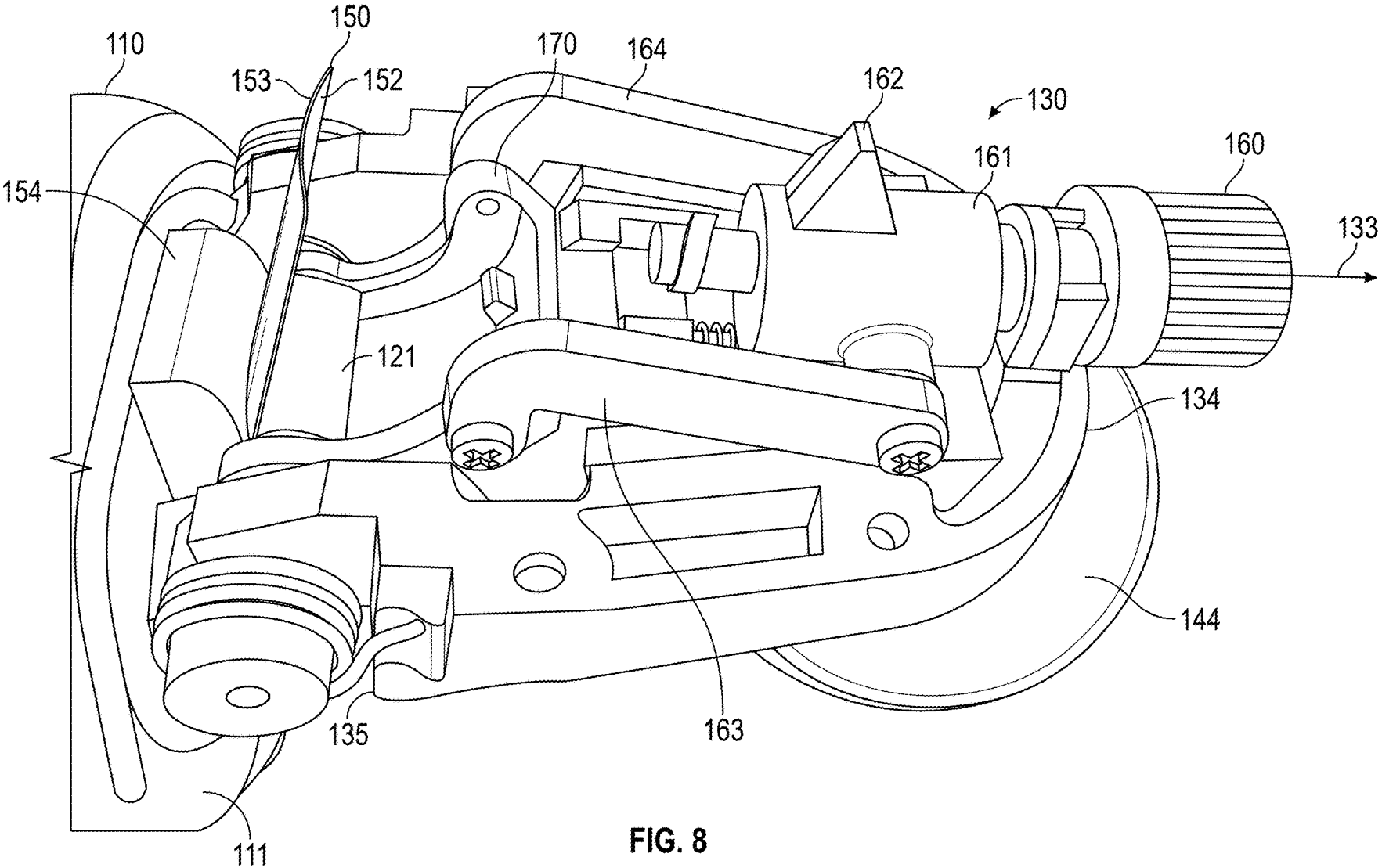
FIG. 8 shows a perspective view of the dorsal interface module according to the first illustrated embodiment.
Figure 9:
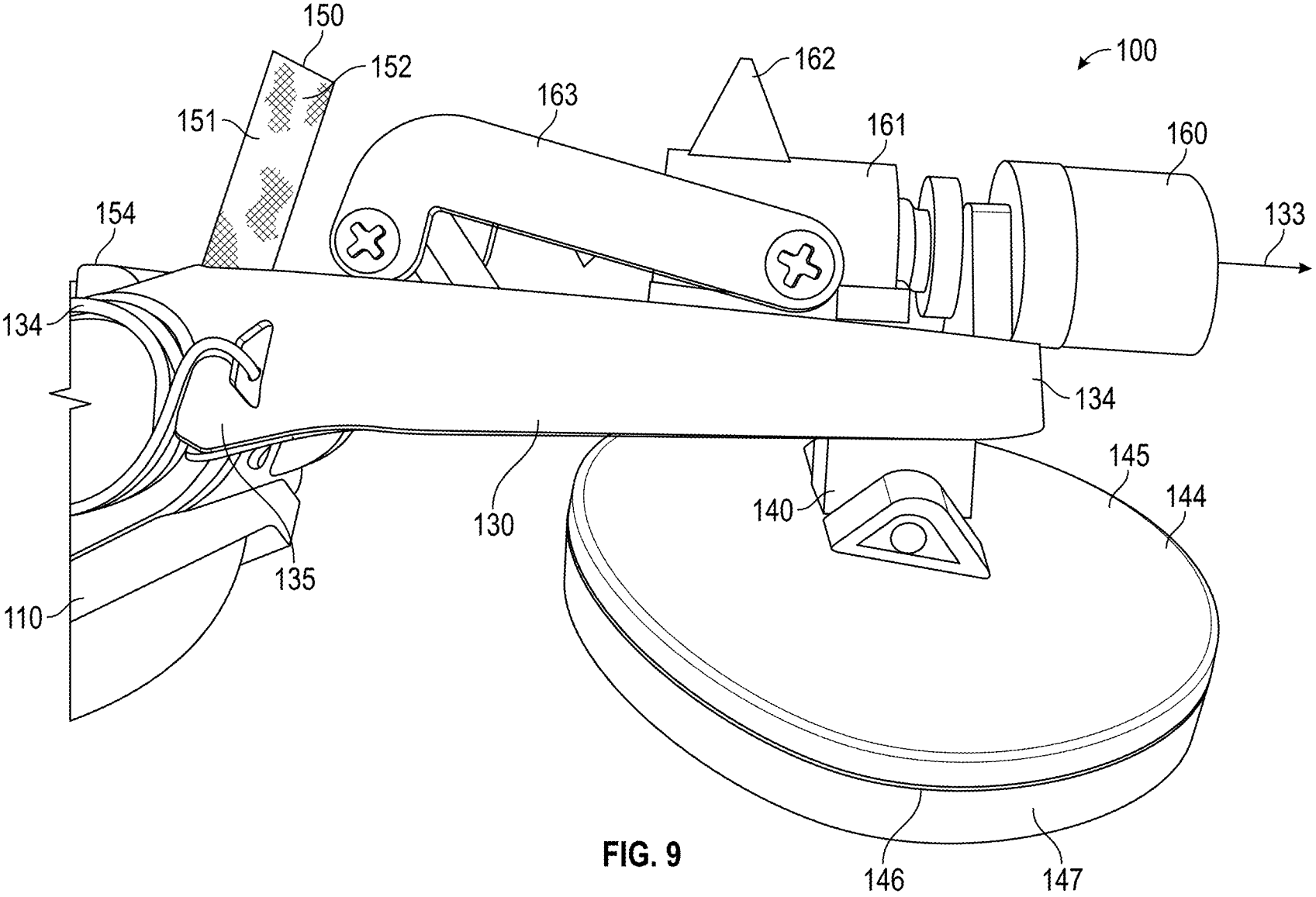
FIG. 9 shows a side view of the dorsal interface module according to the first illustrated embodiment.
Figure 10:
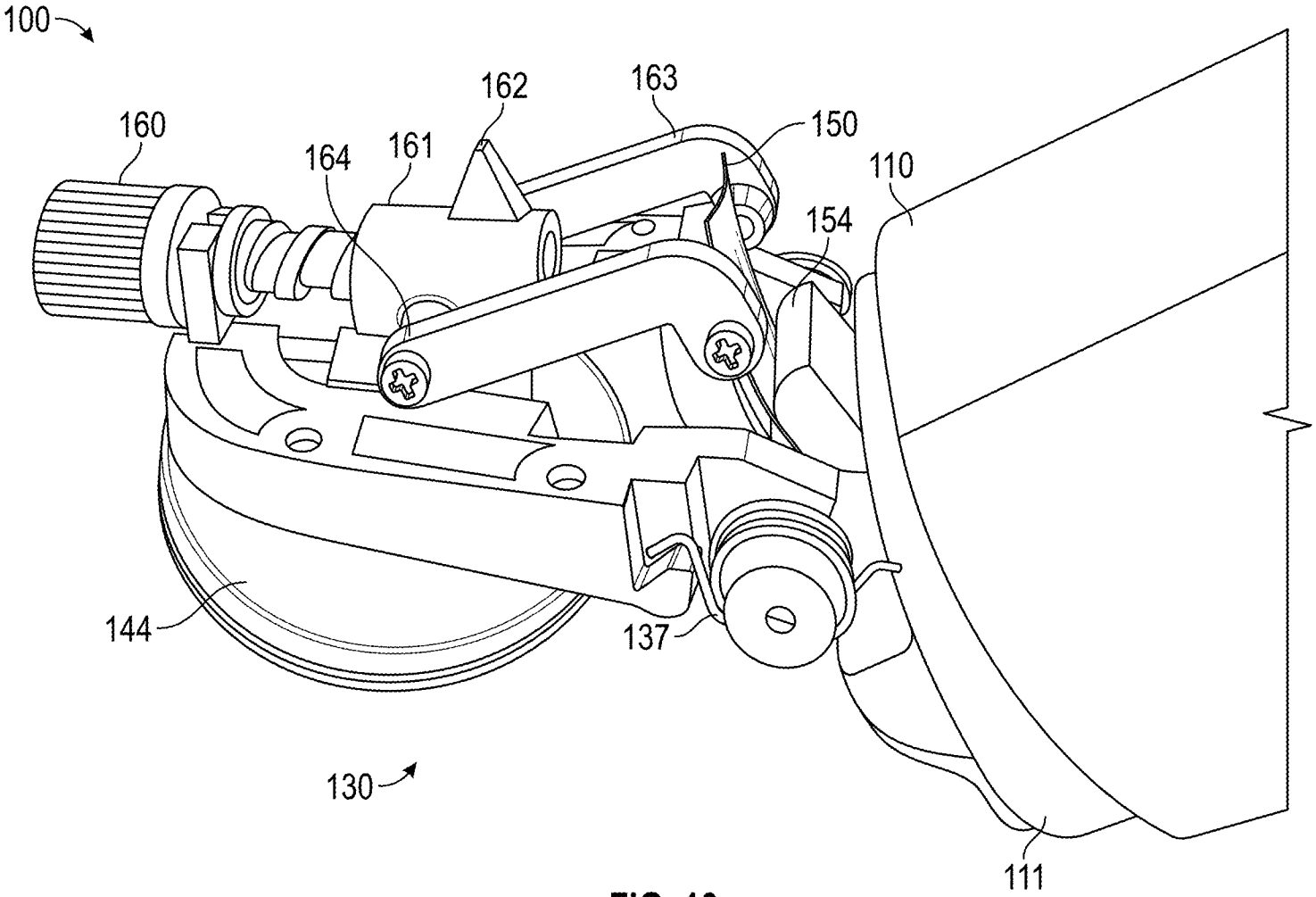
FIG. 10 shows an alternate perspective view of the dorsal interface module in the bent state according to the first illustrated embodiment.
Figure 11:
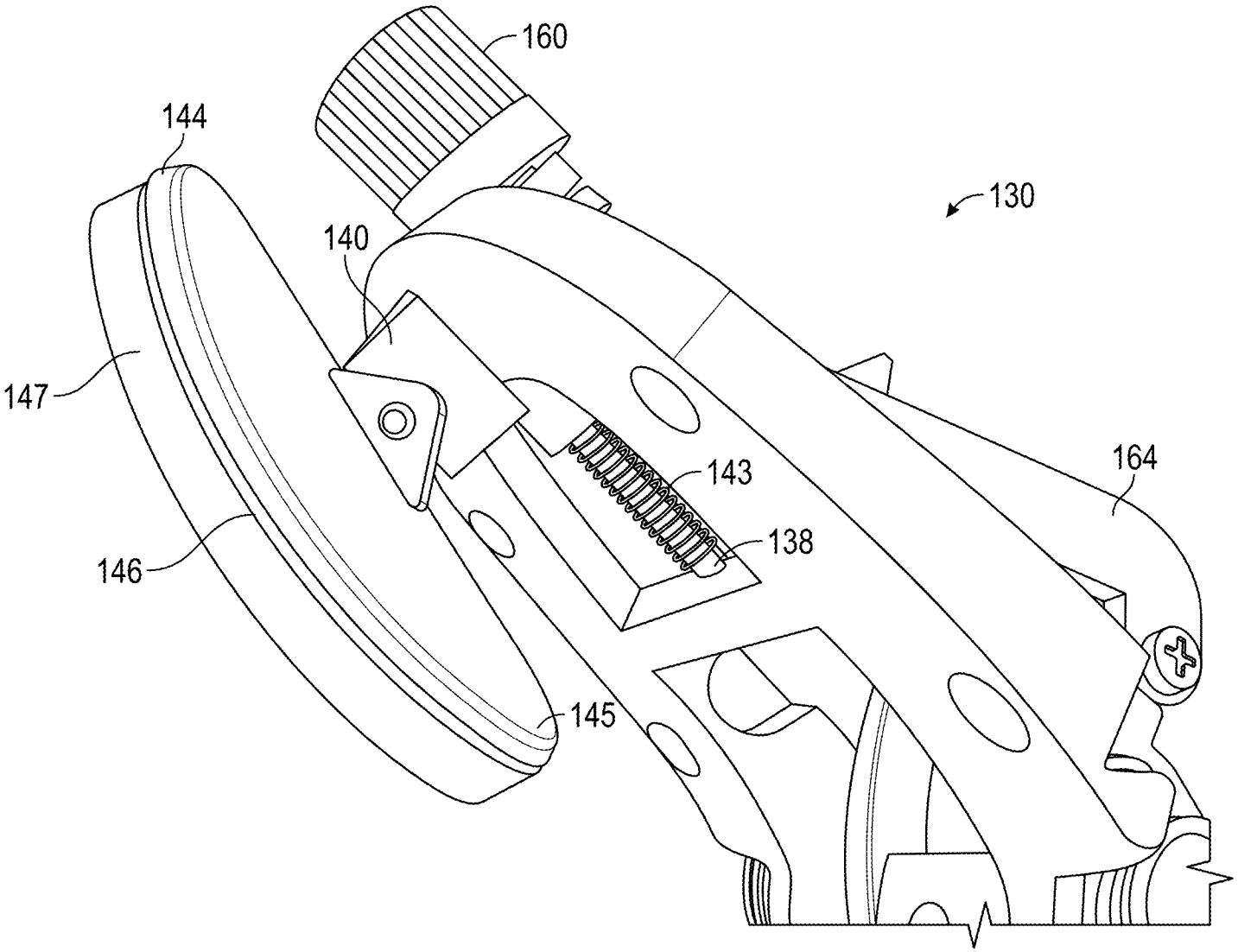
FIG. 11 shows a bottom view of dorsal interface module and a dorsal contact plate according to the first illustrated embodiment.
Figure 12:
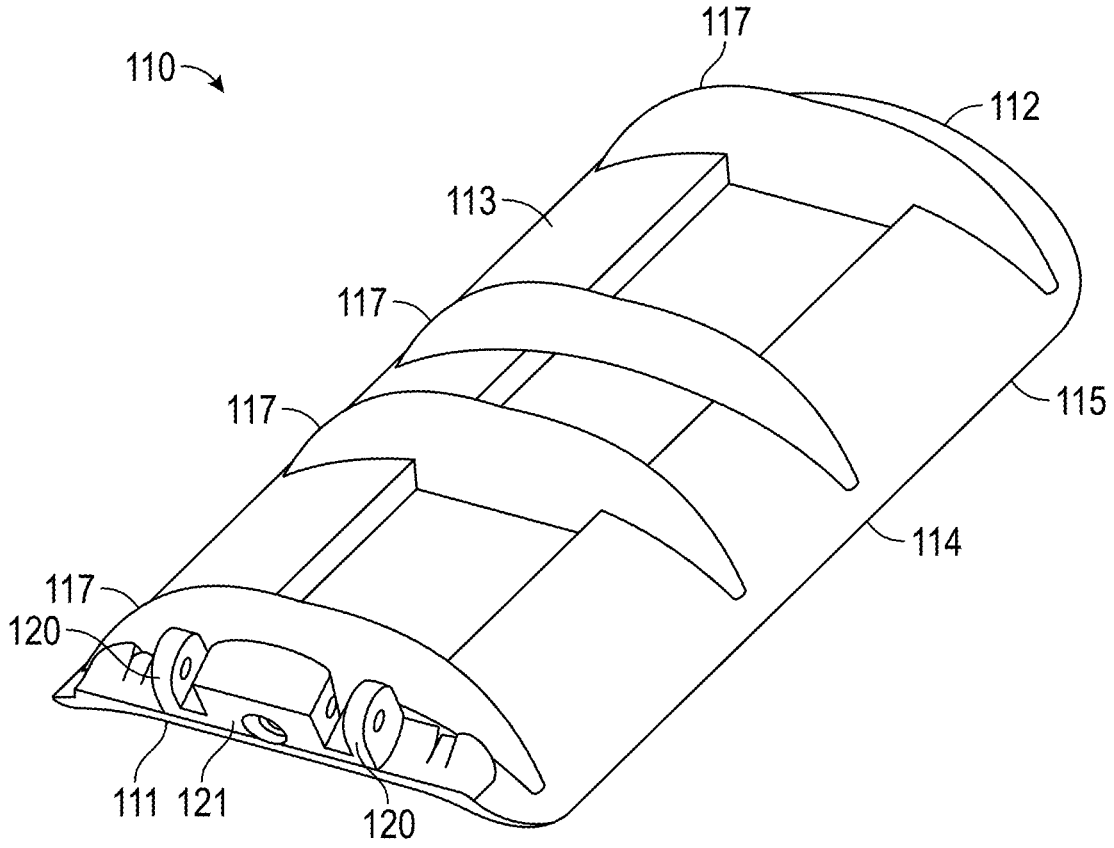
FIG. 12 shows a perspective view of an arm cuff according to the first illustrated embodiment.
Figure 13A:
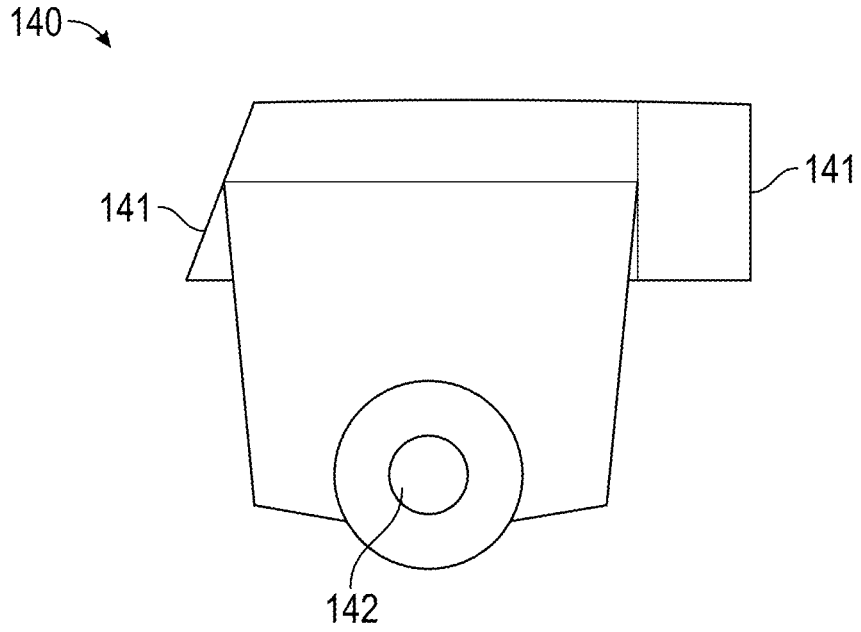
FIG. 13A shows a side view of a gimbal according to the first illustrated embodiment.
Figure 13B:
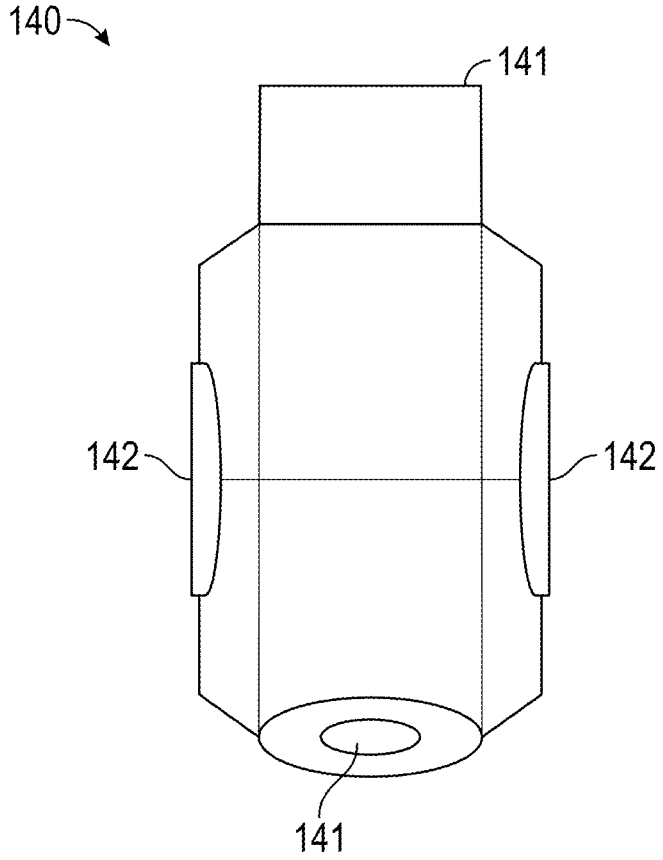
FIG. 13B shows a top view of the gimbal according to the first illustrated embodiment.
Figure 14A:
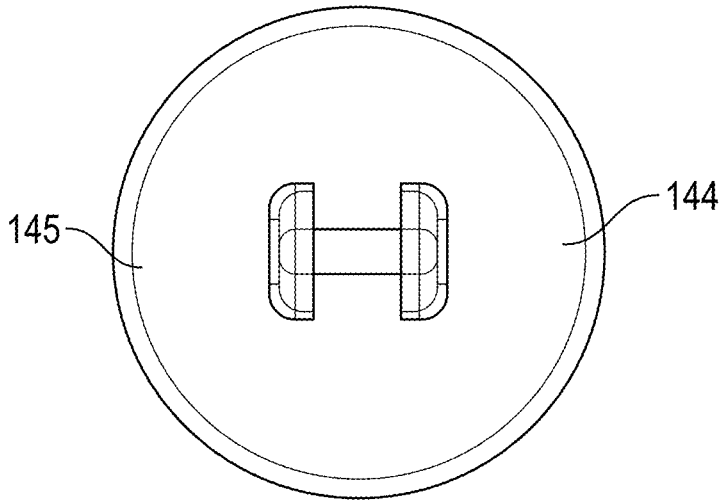
FIG. 14A shows a top view of the dorsal contact plate according to the first illustrated embodiment.
Figure 14B:
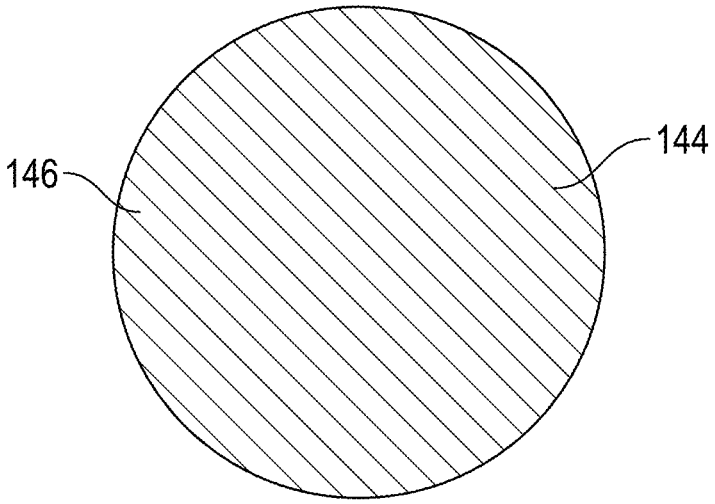
FIG. 14B shows a bottom view of the dorsal contact plate according to the first illustrated embodiment.
Figure 14C:
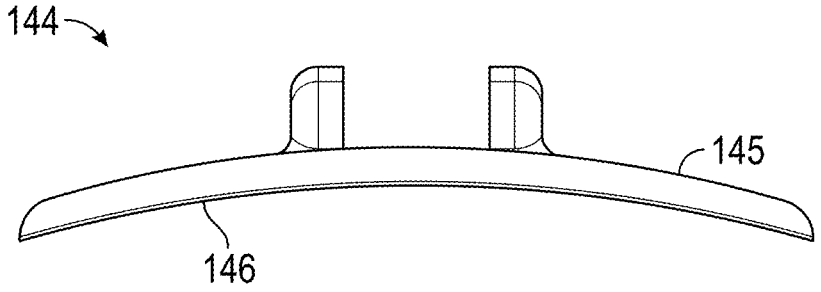
FIG. 14C shows a side view of the dorsal contact plate according to the first illustrated embodiment.
Figure 15A:
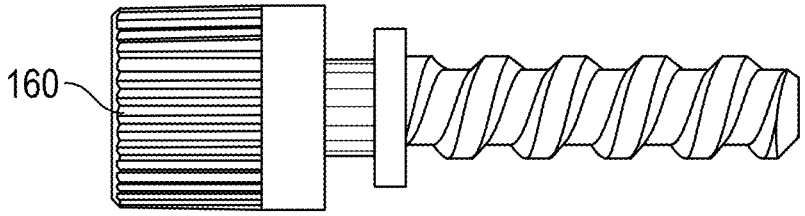
FIG. 15A shows a side view of a set knob according to the first illustrated embodiment.
Figure 15B:
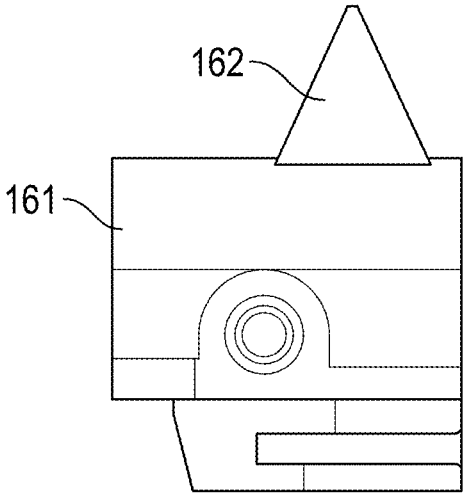
FIG. 15B shows a side view of a shuttle according to the first illustrated embodiment.
Figure 15C:
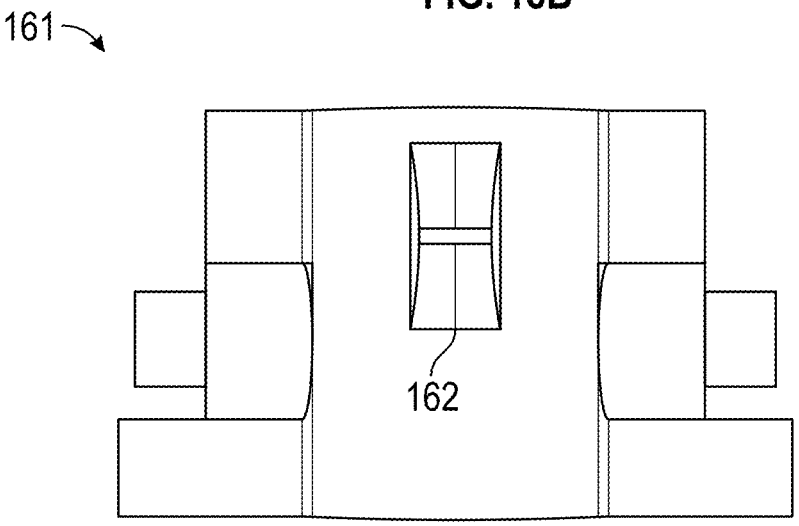
FIG. 15C shows a top view of the shuttle according to the first illustrated embodiment.
Figure 16A:
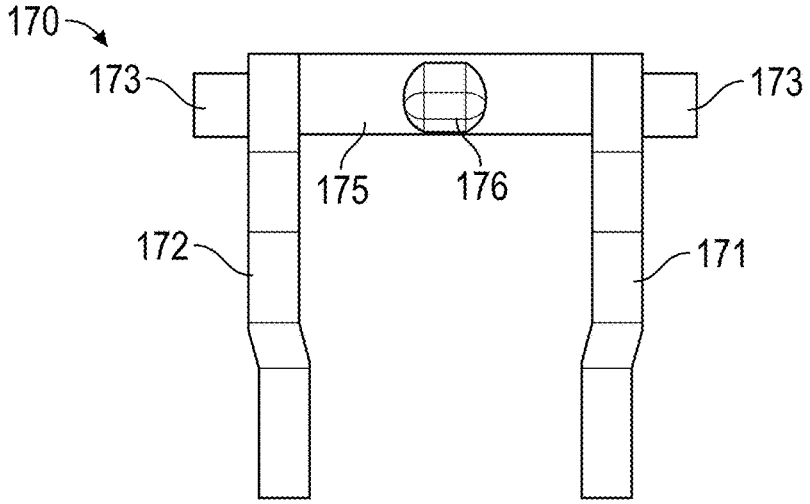
FIG. 16A shows a front view of a trigger according to the first illustrated embodiment.
Figure 16B:
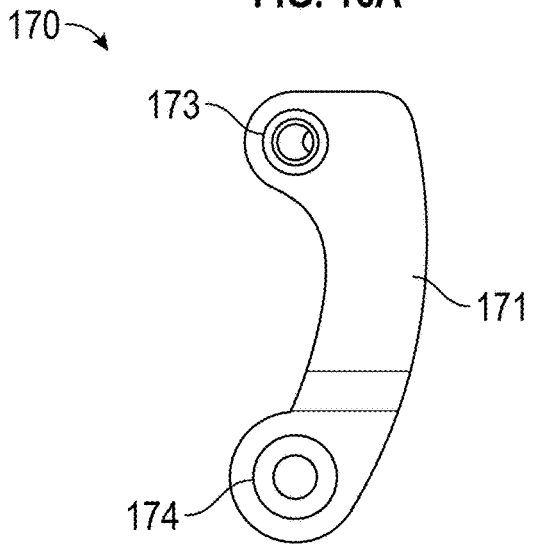
FIG. 16B shows a side view of the trigger according to the first illustrated embodiment.
Figure 16C:
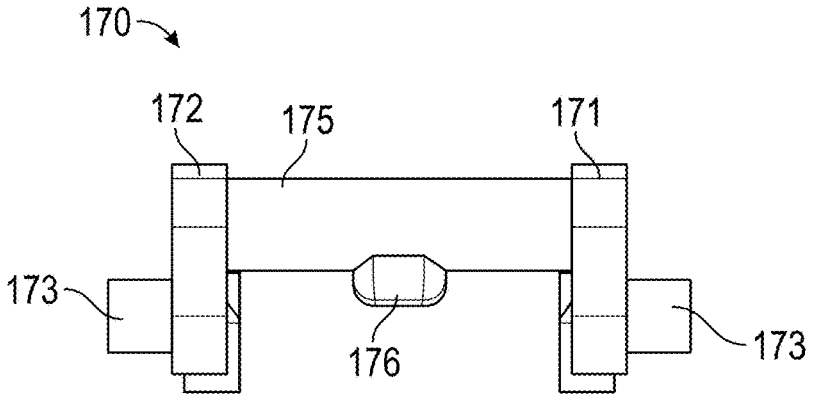
FIG. 16C shows a top view of the trigger according to the first illustrated embodiment.

FIGS. 1 to 16 show the wrist angle feedback apparatus (100) according to the first embodiment. The apparatus (100) is configured to train and monitor the angular relationship between a user's forearm and the back of the user's hand by delivering feedback whenever a predetermined wrist extension angle is reached. The feedback may may auditory, haptic, or both.

The apparatus (100) includes an arm cuff (110) sized to encircle a portion of the user's forearm. The arm cuff (110) has a front end (111) positioned nearest the user's hand and an opposite back end (112). A top face (113) supports arm straps, while a bottom face (114) presents a concave face (115) that conforms anatomically to the forearm. An arm cuff pad (116) is secured to the concave face (115) to enhance comfort and prevent slippage. Two strap guides (117) extend from the top face (113) and retain a first arm strap (118) and a second arm strap (119) that circumferentially tighten the arm cuff (110) on the forearm. At the front end (111), a pair of hinge members (120) project laterally on opposite sides of a longitudinal axis (133) and rotatably support a proximal end (135) of a dorsal interface module (130). A feedback anchor (121) is disposed between the hinge members (120) and fixedly secures a feedback element (150). Adjacent to the forward strap guide (117) a feedback retainer (154) is rigidly mounted to the arm cuff (110). A trigger (170) is pivotally mounted between the hinge members (120) for selective engagement with the feedback element (150), as detailed below.

The dorsal interface module (130) extends along the longitudinal axis (133) from a distal end (134) positioned above the user's hand toward the proximal end (135). The proximal end (135) is hingedly coupled to the hinge members (120) by a first torsion spring (136) and a second torsion spring (137) arranged coaxially with corresponding hinge pins, thereby biasing the dorsal interface module (130) toward a neutral, non-extended orientation. An alignment pin (138) is fixed within the dorsal interface module (130) and projects forward along the longitudinal axis (133). A gimbal (140) is both rotationally and translationally mounted on the alignment pin (138). A compression spring (143) disposed on the alignment pin (138) biases the gimbal (140) toward the distal end (134). The gimbal (140) provides a first rotation point (141) about an axis orthogonal to the longitudinal axis (133) and a second rotation point (142) about an axis parallel to the longitudinal axis (133). The second rotation point (142) connects to a dorsal contact plate (144), permitting the dorsal contact plate (144) to tilt omnidirectionally relative to the dorsal interface module (130). The dorsal contact plate (144) includes a top side (145) joined to the gimbal (140) and a concave bottom side (146) that seats against the back of the user's hand. A dorsal pad (147) on the bottom side (146) distributes pressure and enhances tactile comfort while allowing the hand to move freely in all planes.

The feedback element (150) is an elongated planar body (151) formed with a concave surface (152) that faces the distal end (134) and a convex surface (153) that faces the proximal end (135). The feedback element (150) is fixed to the arm cuff by the feedback anchor (121) and extends into an interior (131) of the dorsal interface module (130). When the feedback element (150) is bent against its curvature toward the arm cuff (110), the feedback element (150) produces mechanical feedback (auditory, haptic, or both). In an alternative configuration the feedback element (150) is flat yet still capable of elastic deformation to generate comparable feedback.

A set knob (160) extends from the exterior (132) of the dorsal interface module (130) and is accessible for manual rotation. The set knob (160) converts rotary input into linear translation of a shuttle (161) that slides along internal guide surfaces. The shuttle (161) carries a set angle indicator (162) projecting through a longitudinal slot in the exterior (132). Wrist angle markings (139) printed linearly alongside the slot cooperate with the set angle indicator (162) to display the angular threshold currently selected by the user. The shuttle (161) further supports a first shuttle arm (163) and a second shuttle arm (164), each articulated to the shuttle (161) and to the trigger (170). Forward translation of the shuttle (161) drives the first shuttle arm (163) and the second shuttle arm (164) to swing the trigger (170) toward the feedback element (150), and rearward translation draws the trigger (170) away, thereby varying the angular displacement required before actuation.

The trigger (170) comprises a first extension (171) and a second extension (172) that is configured to straddle the feedback element (150) upon contact. The first extension (171) includes a first shuttle pivot point (173) coupled to the first shuttle arm (163), while the second extension (172) includes a second shuttle pivot point (174) coupled to the second shuttle arm (164). An engagement post (175) extends between the first extension (171) and the second extension (172) and supports a central projection (176) that is aligned to contact an apex of the concave surface (152) of said feedback element (150). The trigger (170) pivots about the hinge members (120), and the projection (176) selectively presses on the feedback element (150) when the wrist angle exceeds the set angle.

In operation, the user secures the arm cuff (110) to the forearm by tightening the first arm strap (118) and the second arm strap (119) through the strap guides (117). The dorsal contact plate (144) is brought into contact with the back of the hand, where its omnidirectional gimbal (140) connection preserves natural wrist mobility. The user rotates the set knob (160) until the set angle indicator (162) aligns with a desired wrist angle marking (139), positioning the trigger (170) relative to the feedback element (150). As the user extends the wrist backward during, for example, the cocking phase of a golf swing, the dorsal interface module (130) pivots relative to the arm cuff (110) against the restoring torque of the torsion springs (136, 137). When the wrist extension equals the preset angle, the projection (176) on the trigger (170) forcibly bends the feedback element (150) into the feedback retainer (154). Elastic deformation of the feedback element (150) produces an audible click and a tactile pulse, signaling to the user that the target wrist angle has been achieved. Upon releasing wrist extension, the torsion springs (136, 137) urge the dorsal interface module (130) back toward neutral, the trigger (170) pivots away, and the feedback element (150) returns to its undeformed state, ready for the next cycle. An alternative flat feedback element (150) operates identically, relying on planar flexure rather than curvature reversal to generate the same mechanical feedback.

FEATURE LIST apparatus (100)
arm cuff (110)
front end (111)
back end (112)
top face (113)
bottom face (114)
concave face (115)
arm cuff pad (116)
strap guide (117)
first arm strap (118)
second arm strap (119)
hinge member (120)
feedback anchor (121)
dorsal interface module (130)
interior (131)
exterior (132)
longitudinal axis (133)
distal end (134)
proximal end (135)
first torsion spring (136)
second torsion spring (137)
alignment pin (138)
wrist angle markings (139)
gimbal (140)
first rotation point (141)
second rotation point (142)
compression spring (143)
dorsal contact plate (144)
top side (145)
bottom side (146)
dorsal pad (147)
feedback element (150)
planar body (151)
concave surface (152)
convex surface (153)
feedback retainer (154)
set knob (160)
shuttle (161)
set angle indicator (162)
first shuttle arm (163)
second shuttle arm (164)
trigger (170)
first extension (171)
second extension (172)
first shuttle pivot point (173)
second shuttle pivot point (174)
engagement post (175)
projection (176)

What is claimed is:

1. An apparatus for providing wrist angle feedback to a user, comprising:

an arm cuff comprising a front end, a back end opposite the front end, a top face, and a bottom face opposite the top face, the bottom face comprising a concave face configured to engage with a forearm of the user;

one or more arm straps coupled to the arm cuff, a dorsal interface module hingedly coupled to the arm cuff, the dorsal interface module configured to contact a hand backside of the user, the dorsal interface module comprising:

a proximal end and a distal end extending along a longitudinal axis wherein the proximal end is hingedly coupled to the front end of the arm cuff, a dorsal contact plate configured to rotate omnidirectionally, the dorsal contact plate configured to engage with the hand backside of the user;

a set knob externally accessible to a user to adjust a set angle, a shuttle configured to linearly reciprocate upon actuation of the set knob, wherein the shuttle is configured to translate along the longitudinal axis, a trigger coupled to the shuttle wherein upon translation of the shuttle the trigger is configured to rotate toward or away from the arm cuff, wherein the trigger is hingedly coupled to the arm cuff; and a feedback element disposed within the dorsal interface module, the feedback element configured to provide mechanical feedback caused by mechanical deformation of the feedback element to the user upon the set angle between the dorsal interface module and the arm cuff being reached thereby causing the trigger to bend the feedback element, wherein the mechanical feedback comprises auditory feedback, haptic feedback, or both.

2. The apparatus of claim 1, the front end further comprising hinge members configured to engage with the dorsal interface module.

3. The apparatus of claim 1, the dorsal interface module further comprising:

an alignment pin extending along the longitudinal axis; and a gimbal comprising a first rotation point and a second rotation point orthogonal to the first rotation point, the first rotation point rotationally and translationally coupled to the alignment pin;

wherein the dorsal contact plate is rotationally coupled to the second rotation point.

4. The apparatus of claim 1, the feedback element further comprising a concave surface and a convex surface opposite the concave surface, wherein the concave surface faces the distal end of the dorsal interface module and the convex surface faces the proximal end of the dorsal interface module.

5. The apparatus of claim 1, further comprising a feedback retainer coupled to the arm cuff, wherein the feedback element is configured to contact the feedback retainer upon sufficient rotation of the dorsal interface module toward the arm cuff.

6. An apparatus for providing wrist angle feedback to a user, comprising:

an arm cuff comprising a front end, a back end opposite the front end, a top face, and a bottom face opposite the top face, wherein the bottom face is configured to engage with a forearm of the user;

a dorsal interface module hingedly coupled to the arm cuff, the dorsal interface module configured to contact a hand backside of the user, the dorsal interface module comprising a proximal end and a distal end extending along a longitudinal axis wherein the proximal end is hingedly coupled to the front end of the arm cuff; and a feedback element disposed within the dorsal interface module, the feedback element configured to provide feedback to the user upon rotation of the dorsal interface module toward the arm cuff.

7. The apparatus of claim 6, wherein the feedback comprises auditory feedback, haptic feedback, or both.

8. The apparatus of claim 6, wherein the feedback provided by the feedback element is caused by mechanical deformation of the feedback element.

9. The apparatus of claim 8, the mechanical deformation further comprising bending of the feedback element.

10. The apparatus of claim 6, further comprising an arm strap coupled to the arm cuff.

11. The apparatus of claim 6, the front end further comprising hinge members configured to engage with the dorsal interface module.

12. The apparatus of claim 6, the dorsal interface module further comprising a dorsal contact plate configured to rotate omnidirectionally, the dorsal contact plate configured to engage with the hand backside of the user.

13. The apparatus of claim 6, the feedback element further comprising a concave surface and a convex surface opposite the concave surface, wherein the concave surface faces the distal proximal end of the dorsal interface module and the convex surface faces the proximal distal end of the dorsal interface module.

14. The apparatus of claim 6, wherein the feedback element provides the feedback upon a set angle being reached between the dorsal interface module and the arm cuff.

15. The apparatus of claim 14, wherein the set angle is adjustable.

16. The apparatus of claim 15, wherein the set angle is adjustable by a set knob, the set knob being externally accessible from the dorsal interface module.

17. The apparatus of claim 16, the dorsal interface module further comprising a shuttle configured to linearly reciprocate upon actuation of the set knob, wherein the shuttle is configured to translate along the longitudinal axis.

18. The apparatus of claim 17, the shuttle further comprising a set angle indicator, the set angle indicator aligns with wrist angle markings disposed on the dorsal interface module.

19. The apparatus of claim 17, the dorsal interface module further comprising a trigger rotatably coupled to the shuttle wherein upon translation of the shuttle the trigger is configured to rotate toward or away from the feedback element.

* * * * *